US006471121B1

(12) United States Patent
Nielsen

(10) Patent No.: US 6,471,121 B1
(45) Date of Patent: Oct. 29, 2002

(54) STACKABLE TRAY WITH DIVIDER

(75) Inventor: Roderick S. Nielsen, Hinckley, IL (US)

(73) Assignee: Weyerhaeuser, Federal Way, WA (US)

( * ) Notice: Subject to any disclaimer, the term of this patent is extended or adjusted under 35 U.S.C. 154(b) by 0 days.

(21) Appl. No.: 10/011,469

(22) Filed: Nov. 6, 2001

Related U.S. Application Data

(60) Provisional application No. 60/247,136, filed on Nov. 10, 2000.

(51) Int. Cl.[7] ..... B65D 25/04

(52) U.S. Cl. ..... 229/120.17; 229/109; 229/178; 229/120.16

(58) Field of Search ..... 229/120.16, 120.17, 229/109, 178

(56) References Cited

U.S. PATENT DOCUMENTS

| | | | | |
|---|---|---|---|---|
| 370,483 | A | | 9/1887 | Jordan |
| 1,476,750 | A | | 12/1923 | Casey |
| 1,653,116 | A | | 12/1927 | Parks |
| 2,295,141 | A | | 9/1942 | Wingen |
| 2,707,587 | A | | 5/1955 | Wittstein |
| 2,893,621 | A | | 7/1959 | Harnish et al. |
| 3,162,350 | A | | 12/1964 | Miller |
| 3,307,767 | A | | 3/1967 | Humphrey et al. |
| 3,512,699 | A | | 5/1970 | Wilson |
| 3,598,303 | A | | 8/1971 | Folz |
| 3,721,380 | A | | 3/1973 | Meyers |
| 3,876,132 | A | | 4/1975 | Kuchenbecker |
| 3,918,630 | A | | 11/1975 | Meyers |
| 4,058,249 | A | | 11/1977 | Buck |
| 4,151,948 | A | | 5/1979 | de la Fuente, Jr. |
| 4,301,960 | A | | 11/1981 | Alexander et al. |
| 4,356,952 | A | | 11/1982 | Rekow |
| 4,356,953 | A | | 11/1982 | Rekow |
| 4,362,264 | A | | 12/1982 | Duncan |
| 4,371,366 | A | | 2/1983 | Bower et al. |
| 4,372,476 | A | | 2/1983 | Harned et al. |
| 4,436,243 | A | | 3/1984 | Nason et al. |
| 4,848,648 | A | * | 7/1989 | Eisman ..... 229/120.17 |
| 4,905,889 | A | * | 3/1990 | Schuster ..... 229/120.17 |
| 4,923,113 | A | | 5/1990 | Guijarro |
| 4,944,451 | A | * | 7/1990 | Forbes, Jr. ..... 229/120.17 |
| 4,984,734 | A | | 1/1991 | Zion et al. |
| 5,009,363 | A | * | 4/1991 | Zavatone ..... 229/120.16 |
| 5,335,845 | A | | 8/1994 | Liu |
| 5,419,486 | A | * | 5/1995 | Bennett et al. ..... 229/109 |
| 5,487,504 | A | | 1/1996 | Baird |
| 5,588,583 | A | * | 12/1996 | Cargile, Jr. ..... 229/120.17 |
| 5,601,231 | A | | 2/1997 | Cai |
| 5,649,663 | A | | 7/1997 | Pestow, Jr. |
| 5,908,152 | A | * | 6/1999 | Tullis ..... 229/120.16 |

* cited by examiner

*Primary Examiner*—Gary E. Elkins

(57) ABSTRACT

A container is described having a series of bottom panels and a center divider. The center divider divides the container into compartments. Extended outer end panels are provided at the end edges of one compartment, and unextended outer end panels are provided at the end edges of an adjacent compartment. The unextended end panels have inner end panels attached to their outermost edges. Each of the extended outer end panels includes an extension portion. As assembled, these extension portions are sandwiched between their respective unextended outer end panel and its inner end panel. Various embodiments are presented, including one in which minor end flaps are used at the end edges of a center divider panel and inner end panels are attached to the outer edges of the extended end panels. As assembled, the minor end panels are sandwiched between their respective extended outer end panel and its inner end panel.

20 Claims, 6 Drawing Sheets

STACKABLE TRAY WITH DIVIDER

CROSS-REFERENCE TO RELATED APPLICATION

The present application stems from U.S. provisional application No. 60/247,136, filed Nov. 10, 2000, the benefit of which is hereby claimed under 35 U.S.C. §119(e).

FIELD OF THE INVENTION

The present invention relates to corrugated paperboard containers, and more particularly, to containers formed as stackable trays having divided compartments.

BACKGROUND OF THE INVENTION

Various types of open, stackable trays are known in the paperboard container industry. Many of these trays are used for storage and shipment of fresh produce, such as fruits and vegetables. Ideally, such trays should be capable of handling heavy products and capable of being placed in a large stack without collapsing or bending. In addition, certain products benefit from being shipping in a compartmentalized tray. Compartments help reduce movement of the goods inside the tray. Depending on the configuration of the compartment, interior compartment walls can help improve the container's stacking strength and resistance to deformation, as well.

It is known to form compartmentalized trays by simply adding one or more separate upright walls to the interior of the tray, thereby dividing the tray into sections. Such trays are useful, but not especially easy, or efficient, to form. The outer tray walls must be set up and then the interior divider walls made and positioned within the tray. There is further the difficulty of ensuring that the interior divider walls stay properly positioned. These assembly steps take time and at least some degree of skill, if the container is being hand-formed.

Thus, a need exists for a container that takes less skill and time to form, but that has all the benefits of a compartmentalized tray.

SUMMARY OF THE INVENTION

The present invention is directed to fulfilling the above needs and others, as described below.

In accordance with teachings of the present invention, a container and container blank are provided having a series of bottom panels and a center divider. The center divider divides the container into at least first and second compartments. Extended outer end panels are provided at the end edges of one compartment, and unextended outer end panels are provided at the end edges of an adjacent compartment. The unextended end panels have inner end panels attached to their outermost edges. Each of the extended outer end panels includes an extension portion. As assembled, these extension portions are sandwiched between their respective unextended outer end panel and its inner end panel.

In accordance with other aspects of this invention, minor end flaps may be used at the end edges of a center divider panel. In addition, the extended end panels also include inner end panels attached to their outermost edges. As assembled, the minor end flaps of the center divider are located adjacent and inward of the extended outer end panels. This results in the minor end panels being sandwiched between their respective extended outer end panel and its inner end panel.

In accordance with further aspects of this invention, the entire container blank may be formed from a single piece of paperboard material. In one embodiment, mating tabs and slots may be used to hold the various inner end panels in place, as assembled. In another embodiment, corner posts are used to reinforce the container's stacking strength.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein:

FIG. 2 is a perspective view showing minor flaps folded upward and a center divider partially formed;

FIG. 3 is a perspective view showing the center divider fully upright;

FIG. 4 is a perspective view in which the minor flaps are folded outward by a 180° angle and minor side wall end panels are folded upward;

FIG. 5 is a perspective view showing the first and second side walls folded upright and a second end wall partially formed; and FIG. 6 is a perspective view showing the tray as fully erected.

DETAILED DESCRIPTION OF THE PREFERRED EMBODIMENT

Figure 4:
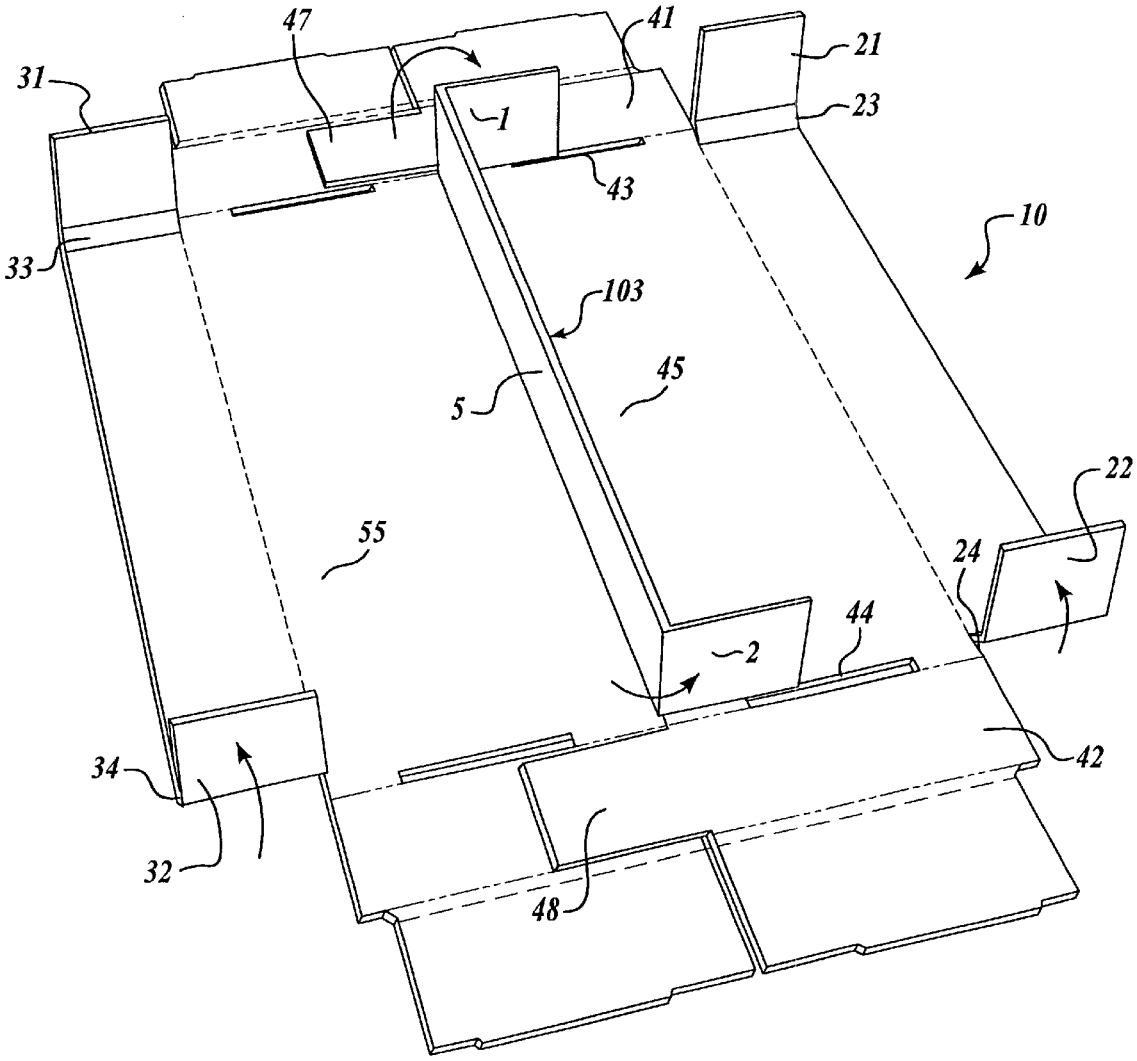
Figure 5:
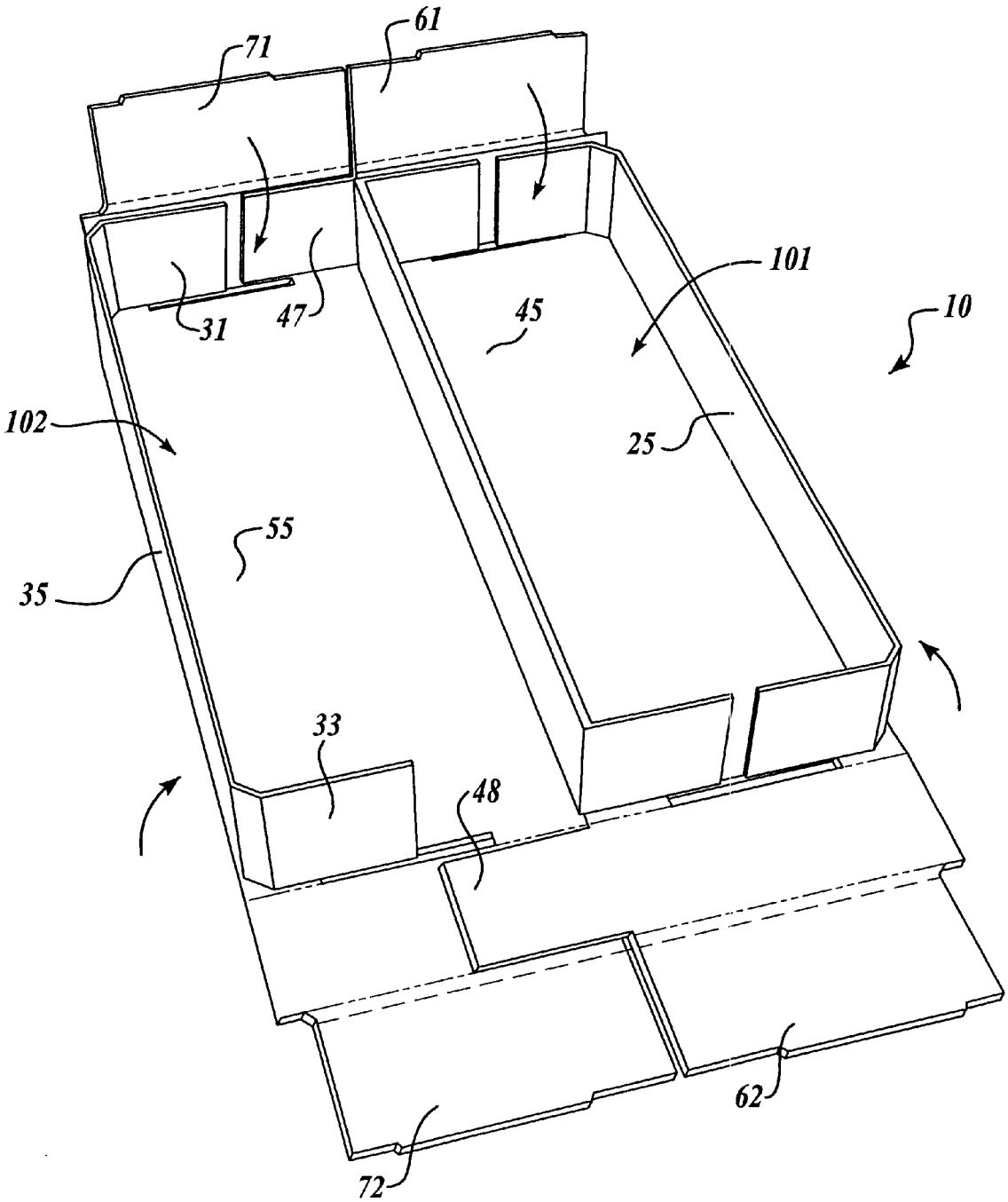
Figure 6:
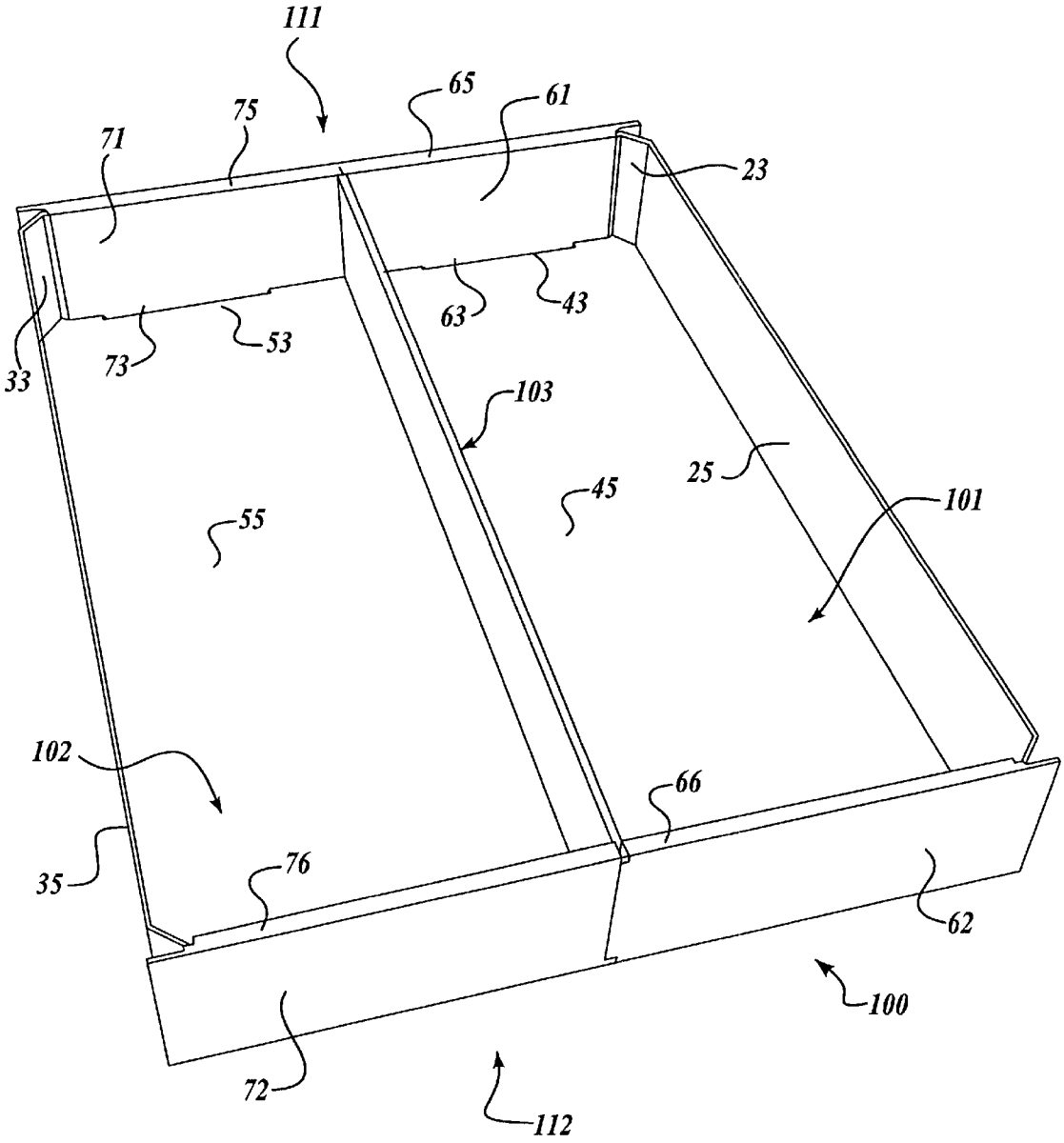

FIGS. 1–6 illustrate one embodiment of a container formed in accordance with the present invention. The container is described herein as a tray, however, other shapes and sizes of the container are possible and, as such, are considered within the broadest scope of the invention. Referring to FIG. 6, the container 100 includes a first compartment 101 and a second compartment 102. These compartments are separated by a central divider 103. In one embodiment of the present invention, the entire tray is formed using a single paperboard blank. As formed, the tray is bounded by a first side wall 25, a second side wall 35, a first end wall 111, and a second end wall 112.

Figure 1:
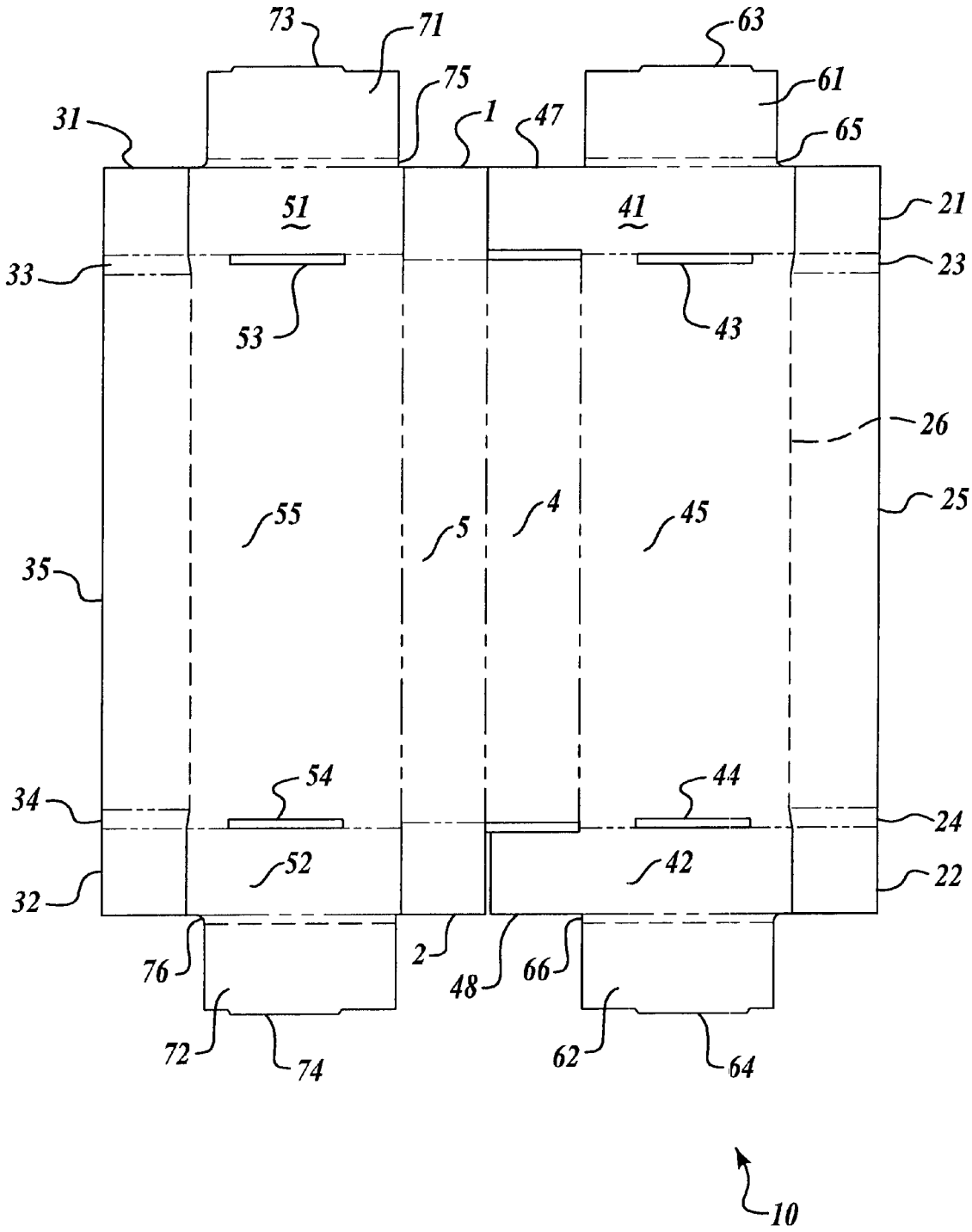
FIG. 1 is a top plan view of one embodiment of a container blank formed in accordance with the present invention after having been cut and scored but prior to being erected into a tray.

Referring now to FIG. 1, one embodiment of a container blank 10 for forming the tray 100 is illustrated. A number of panels are provided that are generally rectangularly shaped. In addition to the first and second side walls 25 and 35, the blank 10 further includes first and second bottom panels 45, 55; first and second extended outer end panels 41, 42; first and second unextended outer end panels 51, 52; first, second, third, and fourth inner end panels 61, 62, 71, 72; first and second center panels 4, 5; first and second minor flaps 1, 2; and first, second, third, and fourth minor side wall flaps 21, 22, 31, 32.

As shown, the second side wall 35, the second bottom panel 55, the first and second center panels 4 and 5, the first bottom panel 45, and the first side wall 25 are hingedly connected to one another in series. Various other panels are hingedly connected to these seriate panels at each of their ends.

The first bottom panel 45 is hingedly connected between an edge of the first extended outer end panel 41 and an edge of the second extended outer end panel 42. These panels are arranged in series, though transverse to the series connection of the side walls to the bottom panels and the center panels. The first and second extended outer end panels 41, 42 include extending portions 47 and 48, respectively. These portions 47, 48 are located adjacent (though unconnected to) the ends of the first center panel 4. A first slot 43 is formed between the first bottom panel 45 and the first extended outer end panel 41. A second slot 44 is formed between the first bottom panel 45 and the second extended outer end panel 42. The outermost edge of the first extended outer end panel 41 is hingedly connected to the first inner end panel 61. The first inner end panel 61 includes a first tab 63 and a first bridge portion 65. Similarly, the outermost edge of the second extended outer end panel 42 is hingedly connected to the second inner end panel 62. The second inner end panel 62 includes a second tab 64 and a second bridge portion 66.

The second bottom panel 55 is hingedly connected between an edge of the first unextended outer end panel 51 and an edge of the second unextended outer end panel 52. These panels are arranged in series, though transverse to the series connection of the side walls to the bottom panels and the center panels. A third slot 53 is formed between the second bottom panel 55 and the first unextended outer end panel 51. A fourth slot 54 is formed between the second bottom panel 55 and the second unextended outer end panel 52. The outermost edge of the first unextended outer end panel 51 is hingedly connected to the third inner end panel 71. The third inner end panel 71 includes a third tab 73 and a third bridge portion 75. Similarly, the outermost edge of the second unextended outer end panel 52 is hingedly connected to the fourth inner end panel 72. The fourth inner end panel 72 includes a fourth tab 74 and a fourth bridge portion 76.

The first and second minor flaps 1, 2 are hingedly connected to the end edges of the second center panel 5. The first and second minor side wall flaps 21, 22 are hingedly connected to the end edges of the first side wall 25. Further, the third and fourth minor side wall flaps 31, 32 are hingedly connected to the end edges of the second side wall 35. In one embodiment, optional first and second corner pieces 23, 24 may be provided at the connection between the minor side walls and their respective side walls. As assembled, these corner pieces provide stacking strength to the container and further help reinforce the container's erected shape.

Figure 2:
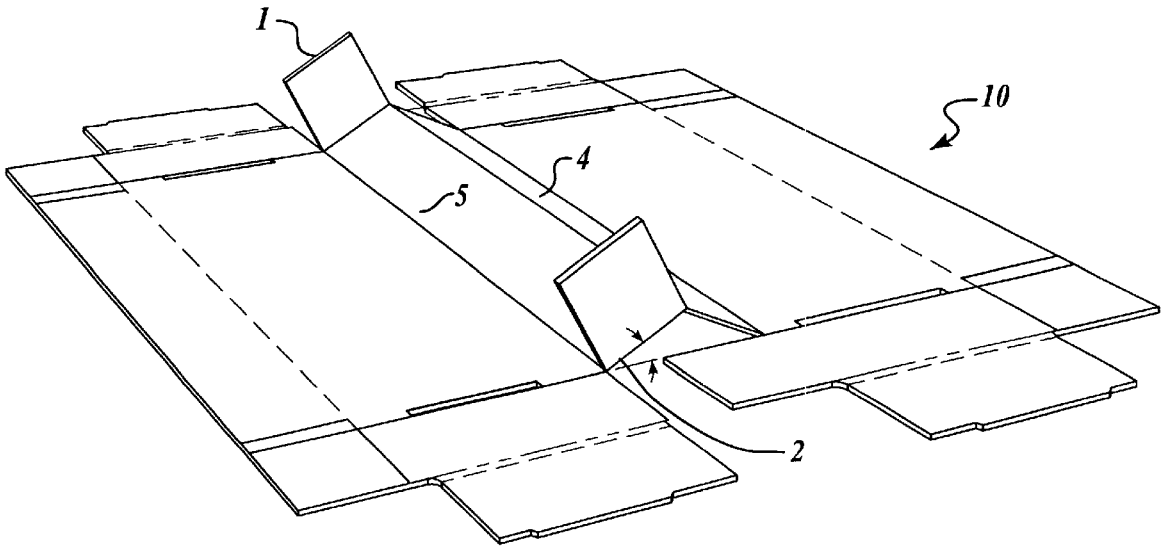
FIGS. 2–6 are perspective views illustrating the forming sequence for the blank of FIG. 1; more specifically.
Figure 3:
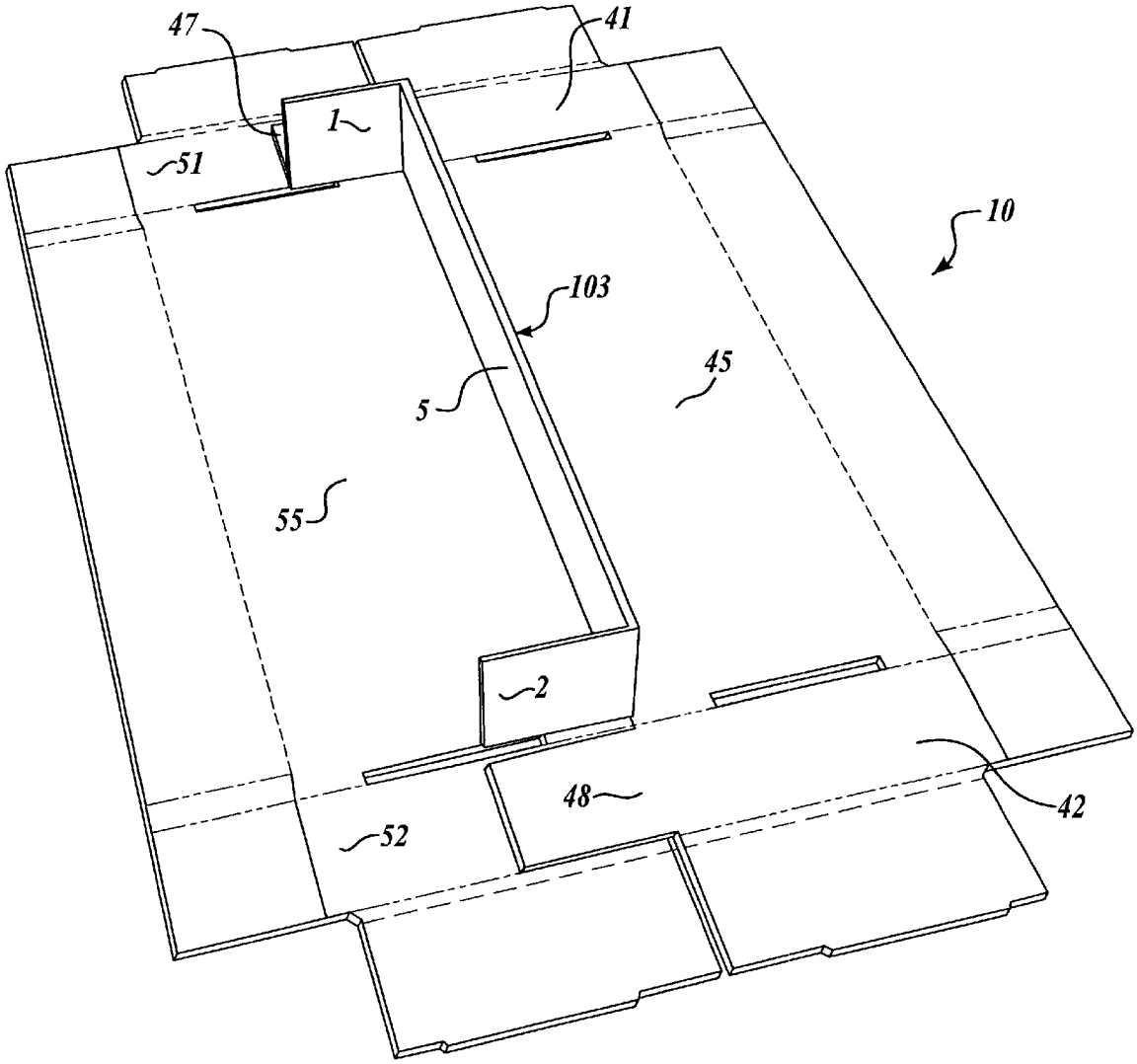

Referring now to FIG. 2, assembly of the tray 100 from the blank 10 begins by folding the first and second minor flaps 1 and 2 upward so that the flaps extend transverse to the surfaces of the bottom panels 45, 55. The first and second center panels 4, 5 are then folded upward toward one another. As folded, the center panels are adjacent one another and thereby form the center divider 103, which divides the first compartment 101 and the second compartment 102 when the tray 100 is fully assembled. As shown in FIG. 3, this step also results in the first and second extending portions 47 and 48 overlapping the first and second unextended outer end panels 51 and 52, respectively. The first and second minor flaps 1 and 2 are now located at the hinged connection between the second bottom panel 55 with the first unextended outer end panel 51 and the second bottom panel 55 with the second unextended outer end panel 52, respectively.

Referring to FIG. 4, the first and second minor flaps 1 and 2 are rotated outwardly by a 180° angle in relation to the center divider 103. This results in the flaps 1, 2 being located at the hinged connection between the first bottom panel 45 with the first extended outer end panel 41 and the first bottom panel 45 with the second extended outer end panel 42, respectively. Thus, the first and second minor flaps 1, 2 now face the first compartment 101 of tray 100. The step of rotating the flaps 1, 2 initiates removably locking the center divider 103 in an erect position. In one embodiment, the flaps 1, 2 may include a bottom tab (not shown) that is made to insert into the slots 43 and 44, respectively.

Still referring to FIG. 4, the minor side wall flaps 21, 22, 31, 32 are folded upward to extend transverse to the surfaces of the bottom panels 45, 55. In one embodiment, optional corner pieces 23, 24, 33, 34 are provided. The optional corner pieces 23, 24, 33, 34 are made to extend at a 45° angle relative to the minor flaps and side walls. The minor flaps 21, 31 and 22, 32 lie in substantially the same upright plane as minor flaps 1 and 2, respectively.

Referring to FIG. 5, the first and second side walls 25 and 35 are folded upward to a 90° angle relative to the surfaces of the bottom panels 45, 55. Next, the first and second extended outer end panels 41, 42 are folded upright along their hinged connections to the first bottom panel 45. As so folded, the extending portions 47 and 48 face the second compartment 102 and are coplanar with the third and fourth minor side wall flaps 31 and 32, respectively. The first and second unextended outer end panels 51, 52 are folded upright along their hinged connections to the second bottom panel 55. The unextended outer end panels 51, 52 are exterior to the extending portions 47 and 48.

Referring to FIGS. 5 and 6, the first and second inner end panels 61, 62 are folded inward about the extended outer end panels 41, 42, respectively. The first tab 63 is inserted into slot 43. This action sandwiches the first minor flap 1 and the first minor side wall flap 21 between the first extended outer end panel 41 and the first inner end panel 61. Likewise, the second tab 64 is inserted into slot 44. This action sandwiches the second minor flap 2 and the second minor side wall flap 22 between the second extended outer end panel 42 and the second inner end panel 62. Similarly, the third and fourth tabs 73 and 74 are inserted into their respective slots 53 and 54. These actions result in sandwiching the third minor side wall flap 31 and the first extending portion 47 between the first unextended outer end panel 51 and third inner end panel 71, and also sandwiching the fourth minor side wall flap 32 and the second extending portion 48 between the second unextended outer end panel 52 and fourth inner end panel 72.

The folding of the inner end panels 61, 62, 71, and 72 results in their respective bridge portions 65, 66, 75, and 76 being folded generally parallel to the surface of the bottom panels 45, 55. The folding inward of the inner end panels 61, 62, 71, 72 also results in the formation of the first and second end walls 111, 112. The first end wall 111 comprises the first extended outer end panel 41 in an erect position, the first unextended outer end panel 51 in an erect position, first and third inner end panels 61 and 71 removably inserted into slots 43 and 53, respectively, and first and third minor side walls 21 and 31 sandwiched between their respective inner and outer end panels. The second end wall 112 comprises the second extended outer end panel 42 in an erect position, the second unextended outer end panel 52 in an erect position, second and fourth inner end panels 62 and 72 removably inserted into slots 44 and 54, respectively, and second and fourth minor side walls 22 and 32 sandwiched between their respective inner and outer end panels.

Referring to FIG. 6, tray 100 is shown with the first compartment 101, the second compartment 102, the central divider 103, the first end wall 111, and the second end wall 112. The first compartment 101 of tray 100 is bounded by the first bottom panel 45, the center divider 103, the first side wall 25, a portion of the first end wall 111, and a portion of the second end wall 112. The second compartment 102 is bounded by the second bottom panel 55, the center divider 103, the second side wall 35, a portion of the first end wall 111, and a portion of the second end wall 112.

As will be appreciated from a reading of the above, the container of the present invention has a number of advantages over prior compartmentalized designs. In particular, the end walls are supported by members sandwiched between the outer end panels and the inner end panels. This is accomplished by rotating the first and second minor flaps 180 degrees and by using the extended portion of the extended outer end panels to fill the "void" left by the rotation of the first and second minor flaps. This buildup of end wall material improves the container's overall stacking strength and resistance to deformation. The optional use of cornerposts helps as well. The present invention is also easily formed by hand. It does not require a great deal of skill or time. Further, the container does not require additional components to ensure the proper formation and positioning of the interior center panels.

While the preferred embodiment of the invention has been illustrated and described, it will be appreciated that various changes can be made therein without departing from the spirit and scope of the invention. For example, the connections between various pieces of the blank may be formed from a fold line, a score line, or any other hinged connection known in the art for allowing the panels to move relative to one another. By way of another example, the unextended outer end panels may, in fact, be provided with extension material. If so provided, these additional extension portions may be positioned outward of the first and second extended outer end panels or, alternatively and depending on their size, they may be positioned between the extended outer end panels and their respective inner end panels.

The embodiments of the invention in which an exclusive property or privilege is claimed are defined as follows:

1. A container blank comprising:

(a) a first bottom panel, a first center panel, a second center panel, and a second bottom panel; these panels being hingedly connected to one another in series and each panel including opposed end edges;

(b) a first extended outer end panel hingedly connected to an end edge of the first bottom panel; a second extended outer end panel hingedly connected to the other end edge of the first bottom panel; the first extended outer end panel, the first bottom panel, and the second extended outer end panel thus being hingedly connected in series; the first and second extended outer end panels each having a portion adjacent the bottom panel and an extension portion adjacent, though not connected to, the edge of the first center panel;

(c) a first unextended outer end panel hingedly connected to an end edge of the second bottom panel; a third inner end panel hingedly connected to an outer edge of the first unextended outer end panel; a second unextended outer end panel hingedly connected to the other end edge of the second bottom panel; a fourth inner end panel hingedly connected to an outer edge of the second unextended outer end panel; the third inner end panel, the first unextended outer end panel, the second bottom panel, the second unextended outer end panel, and the fourth inner end panel thus being hingedly connected in series;

wherein, as assembled, the first and second center panels are folded upward onto one another to form a center divide, thus causing the first and second extension portions to move adjacent and inward of the first and second unextended outer end panels, respectively; the third and fourth inner end panels being folded inward and held therein; the first extension portion being sandwiched between the first unextended outer end panel and the third inner end panel; the second extension portion being sandwiched between the second unextended outer end panel and the fourth inner end panel.

2. The blank of claim 1, wherein the blank is formed from a single piece of paperboard material.

3. The blank of claim 1, further comprising a first side wall hingedly connected to an outer side edge of the first bottom panel and a second side wall hingedly connected to an outer side edge of the second bottom panel.

4. The blank of claim 3, wherein the first and second side walls each include opposed end edges; and the first side wall includes first and second minor side wall flaps hingedly connected along its opposed end edges; the second side wall includes third and fourth minor side wall flaps hingedly connected along its opposed end edges; as assembled, the first minor side wall flap is sandwiched between the first extended outer end panel and the first inner end panel, the second minor side wall flap is sandwiched between the second extended outer end panel and the second inner end panel, the third minor side wall flap is sandwiched between the first unextended outer end panel and the third inner end panel; and the fourth minor side wall flap is sandwiched between the second unextended outer end and the fourth inner end panel.

5. The blank of claim 4, wherein at least one of the first and second side walls includes a corner piece located at at least one of its hinged connections to its respective minor side wall flaps.

6. The blank of claim 5, wherein the corner piece forms a triangular cornerpost as assembled.

7. The blank of claim 1, further comprising (a) a first minor end flap hingedly connected to an end edge of the second center panel; and a second minor end flap hingedly connected to the other end edge of the second center panel; and (b) a first inner end panel hingedly connected to an outer edge of the first extended outer end panel; a second inner end panel hingedly connected to an outer edge of the second extended outer end panel; the first inner end panel, the first extended outer end panel, the first bottom panel, the second extended outer end panel, and the second inner end panel thus being hingedly connected in series;

wherein, as assembled, the first and second minor end panels are located adjacent and inward of the first and second extended outer end panels, respectively; the first and second inner end panels being folded inward and held therein; the first minor end panel being sandwiched between the first extended outer end panel and the first inner end panel; the second minor end panel being sandwiched between the second extended outer end panel and the second inner end panel.

8. The blank of claim 7, wherein the blank is formed from a single piece of paperboard material.

9. The blank of claim 7, wherein the first, second, third, and fourth inner end panels each include a tab along their exterior edges; the first and second extended outer end panels and the first and second unextended outer end panels each include a slot along their respective hinged connections to the first and second bottom panels, respectively; the tabs engaging their respective slots in order to hold the inner panels in place as assembled.

10. The blank of claim 7, wherein the first, second, third, and fourth inner end panels each include a bridge portion along their hinged connection to the first and second extended outer end panels and the first and second unextended outer end panels, respectively; as assembled, the bridge portions being generally laterally oriented.

11. The blank of claim 7, further comprising a first side wall hingedly connected to an outer side edge of the first bottom panel and a second side wall hingedly connected to an outer side edge of the second bottom panel.

12. The blank of claim 11, wherein the first and second side walls each include opposed end edges; and the first side wall includes first and second minor side wall flaps hingedly connected along its opposed end edges; the second side wall includes third and fourth minor side wall flaps hingedly connected along its opposed end edges; as assembled, the first minor side wall flap is sandwiched between the first extended outer end panel and the first inner end panel, the second minor side wall flap is sandwiched between the second extended outer end panel and the second inner end panel, the third minor side wall flap is sandwiched between the first unextended outer end panel and the third inner end panel; and the fourth minor side wall flap is sandwiched between the second unextended outer end and the fourth inner end panel.

13. The blank of claim 12, wherein at least one of the first and second side walls includes a corner piece located at at least one of its hinged connections to its respective minor side wall flaps.

14. The blank of claim 13, wherein the corner piece forms a triangular cornerpost as assembled.

15. A container comprising:

(a) a first bottom panel, a first center panel, a second center panel, and a second bottom panel; these panels being hingedly connected to one another in series and each panel including opposed end edges;

(b) a first extended outer end panel hingedly connected to an end edge of the first bottom panel; a second extended outer end panel hingedly connected to the other end edge of the first bottom panel; the first extended outer end panel, the first bottom panel, and the second extended outer end panel thus being hingedly connected in series; the first and second extended outer end panels each having a portion adjacent the bottom panel and an extension portion adjacent, though not connected to, the edge of the first center panel;

(c) a first unextended outer end panel hingedly connected to an end edge of the second bottom panel; a third inner end panel hingedly connected to an outer edge of the first unextended outer end panel; a second unextended outer end panel hingedly connected to the other end edge of the second bottom panel; a fourth inner end panel hingedly connected to an outer edge of the second unextended outer end panel; the third inner end panel, the first unextended outer end panel, the second bottom panel, the second unextended outer end panel, and the fourth inner end panel thus being hingedly connected in series;

(d) a first minor end flap hingedly connected to an end edge of the second center panel; and a second minor end flap hingedly connected to the other end edge of the second center panel; and (e) a first inner end panel hingedly connected to an outer edge of the first extended outer end panel; a second inner end panel hingedly connected to an outer edge of the second extended outer end panel; the first inner end panel, the first extended outer end panel, the first bottom panel, the second extended outer end panel, and the second inner end panel thus being hingedly connected in series;

wherein, as assembled, the first and second center panels are folded upward onto one another to form a center divide, thus causing the first and second extension portions to move adjacent and inward of the first and second unextended outer end panels, respectively; the third and fourth inner end panels being folded inward and held therein; the first extension portion being sandwiched between the first unextended outer end panel and the third inner end panel; the second extension portion being sandwiched between the second unextended outer end panel and the fourth inner end panel;

wherein the blank is formed from a single piece of paperboard material; and wherein, as assembled, the first and second minor end panels are located adjacent and inward of the first and second extended outer end panels, respectively; the first and second inner end panels being folded inward and held therein; the first minor end panel being sandwiched between the first extended outer end panel and the first inner end panel; the second minor end panel being sandwiched between the second extended outer end panel and the second inner end panel;

wherein the first, second, third, and fourth inner end panels each include a tab along their exterior edges; the first and second extended outer end panels and the first and second unextended outer end panels each include a slot along their respective hinged connections to the first and second bottom panels, respectively; the tabs engaging their respective slots in order to hold the inner panels in place, as assembled.

16. The blank of claim 15, wherein the first, second, third, and fourth inner end panels each include a bridge portion along their hinged connection to the first and second extended outer end panels and the first and second unextended outer end panels, respectively; as assembled, the bridge portions being generally laterally oriented.

17. The container of claim 15, further comprising a first side wall hingedly connected to an outer side edge of the first bottom panel and a second side wall hingedly connected to an outer side edge of the second bottom panel.

18. The container of claim 17, wherein the first and second side walls each include opposed end edges; and the first side wall includes first and second minor side wall flaps hingedly connected along its opposed end edges; the second side wall includes third and fourth minor side wall flaps hingedly connected along its opposed end edges; as assembled, the first minor side wall flap is sandwiched between the first extended outer end panel and the first inner end panel, the second minor side wall flap is sandwiched between the second extended outer end panel and the second inner end panel, the third minor side wall flap is sandwiched between the first unextended outer end panel and the third inner end panel; and the fourth minor side wall flap is sandwiched between the second unextended outer end and the fourth inner end panel.

19. The container of claim 18, wherein at least one of the first and second side walls includes a corner piece located at at least one of its hinged connections to its respective minor side wall flaps.

20. The container of claim 19, wherein the corner piece forms a triangular cornerpost as assembled.

* * * * *